US007066151B1

(12) United States Patent
Bos

(10) Patent No.: US 7,066,151 B1
(45) Date of Patent: Jun. 27, 2006

(54) FUEL INJECTOR WITH SPILL CHAMBER

(75) Inventor: Mark Bos, Sand Lake, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/907,601

(22) Filed: Apr. 7, 2005

(51) Int. Cl.
*F02M 37/04* (2006.01)

(52) U.S. Cl. ..... 123/467; 123/506

(58) Field of Classification Search ..... 123/467, 123/446, 447, 506, 456, 500–501
See application file for complete search history.

(56) References Cited

U.S. PATENT DOCUMENTS 3,779,225 A * 12/1973 Watson et al. ..... 123/449
4,612,893 A * 9/1986 Ishibashi et al. ..... 123/447
4,624,233 A * 11/1986 Phillips ..... 123/506
4,881,504 A * 11/1989 Best ..... 123/447
5,626,119 A * 5/1997 Timms ..... 123/467
5,893,350 A * 4/1999 Timms ..... 123/467
6,763,809 B1 * 7/2004 Grabandt ..... 123/467
6,868,831 B1 * 3/2005 Lei ..... 123/467
2003/0159678 A1 * 8/2003 Egler et al. ..... 123/447

* cited by examiner

*Primary Examiner*—Carl S. Miller
(74) *Attorney, Agent, or Firm*—McGarry Bair PC

(57) ABSTRACT

A fuel injection system has a spill chamber fluidly connected between a high pressure side and low pressure side with a spill valve that is synchronized with the control valve. The spill chamber has a movable piston that is pressure balanced at a first position during fuel injection and fuel filling, but moves to a second position increasing volume in the high pressure side during a spill event at the termination of injection.

26 Claims, 5 Drawing Sheets

FUEL INJECTOR WITH SPILL CHAMBER

FIELD OF THE INVENTION

This invention relates to fuel injection systems and more particularly to pressure controls for a fuel injector.

DESCRIPTION OF THE RELATED ART

A fuel injection system will typically have a cam driven pump that pressurizes fuel in a high pressure conduit leading to the injector nozzle, all of which is sometimes referred to as the high pressure side of the system. For an injection event, the injector nozzle delivers a predetermined, metered amount of fuel to the combustion chamber at preselected intervals. A control valve fluidly connected between a low pressure side and the high pressure side initiates an injection event by closing to permit pressure to increase in the high pressure conduit. The control valve stops an injection event by opening so that fuel can spill to the low pressure side, thereby reducing pressure in the high pressure side and terminating the injection event. In the case of compression ignition, or diesel engines, relatively high fuel pressures are achieved in the high pressure side. Presently, conventional injectors are delivering fuel at pressures on the order of 29,000 psi (2,000 bar).

Problems arise when the control valve opens to spill fuel, due largely to the stored energy in fluid at high pressure. As the control valve begins to open, fuel starts flowing through the valve to the low pressure side at high velocity. It can take as little as a reduction in 5% of the volume of fuel in the high pressure side to reduce pressure from 2000 bar to zero. But there is inertia in the flow to the low pressure side that tends to cause a negative pressure in the high pressure side, or at least reduce pressure to at or below the vapor pressure of the fuel. As a result, some fuel remaining in the high pressure side vaporizes. This vapor affects the timing of a subsequent injection event, because the pump must compress the vapor before it can begin to pressurize the fuel in the high pressure side. Also, the presence of vapor in the high pressure side leads to post-injection cavitation. The drive train that operates the pump has enough play that it tends to act like a spring. It is believed that this drive train "wind up", along with vapor in the line, contributes to some cavitation in the high pressure side after each injection event. The consequences to these long standing problems in timing and cavitation are reduced performance and diminished durability.

SUMMARY OF THE INVENTION

The foregoing problems are solved by the present invention of an improvement in a fuel injection system of the type having a pump fluidly connected to an injector nozzle on a high pressure side, and a control valve fluidly connected between the high pressure side and a low pressure side, whereby the nozzle can be opened and closed by activation or deactivation of the control valve. An injection event will occur when the control valve is actuated and will not occur when the control valve is not actuated. The improvement is found in a spill chamber with a movable piston, fluidly connected between the high pressure side and the low pressure side. The piston is movable between a first position that provides no change in the volume of the high side and a second position that increases the volume of the high side. Also included are means to hold the piston in the first position until termination of an injection event in order to absorb stored energy in the pressurized fuel when the control valve is deactivated.

When the piston is in the second position, fuel pressure in the high side is reduced. Ideally, the volume increase is about 5%.

A spring in a spring side of the spill chamber can be provided to bias the piston toward the first position. Further, a spill valve on the low pressure side of the spill chamber is preferably synchronized with the control valve. In this case, the spring side is fluidly connected to the high pressure conduit and also to the spill valve.

A pressure side of the spill chamber opposite the piston from the spring side can be fluidly connected to the high pressure conduit. Preferably, the spring side is fluidly connected to the high pressure conduit by way of a restriction.

In one aspect, a fuel injection system according to the invention comprises a spill valve on the low pressure side of the spill chamber where the spill valve is synchronized with the control valve. In one embodiment, the spill valve is a spool valve integral with the control valve. The control valve comprises a barrel with an annular groove disposed to move into registry with the high pressure side and the low pressure side when the control valve is deactivated, and move out of registry with the high pressure side when the control valve is activated. Similarly, the spool valve comprises an annular groove on the barrel disposed to move into fluid communication with the spill chamber and the low pressure side when the control valve is deactivated, and move out of fluid communication with the spill chamber when the control valve is activated.

Another aspect of the invention is an improvement in a fuel injection system comprising a pump fluidly connected to an injector nozzle by way of a high pressure conduit in a high pressure side for pressurizing fuel in the high pressure side prior to an injection event. A control valve is fluidly connected between the high pressure side and a low pressure side wherein the injection event occurs by opening the injector nozzle when the control valve is activated and the injection event is terminated by a spill event when the control valve is deactivated. The improvement lies in a spill chamber fluidly connected to the high pressure side, with a movable piston dividing the spill chamber into a first side and a second side, configured to bias the toward the second side only termination of an injection event. The result is to accelerate the pressure drop in the high pressure side during the spill and overcome the effects of inertia in the control valve during a spill event.

Preferably, the spill chamber is configured to increase the volume of the high pressure side at the beginning of the spill event. That volume increase is ideally about 5%.

In another aspect, both sides are fluidly connected to the high pressure side. A restriction in the fluid connection can also be provided between the first side and the high pressure side. Preferably, the first side is fluidly connected to the low pressure side.

DETAILED DESCRIPTION

Figure 1:
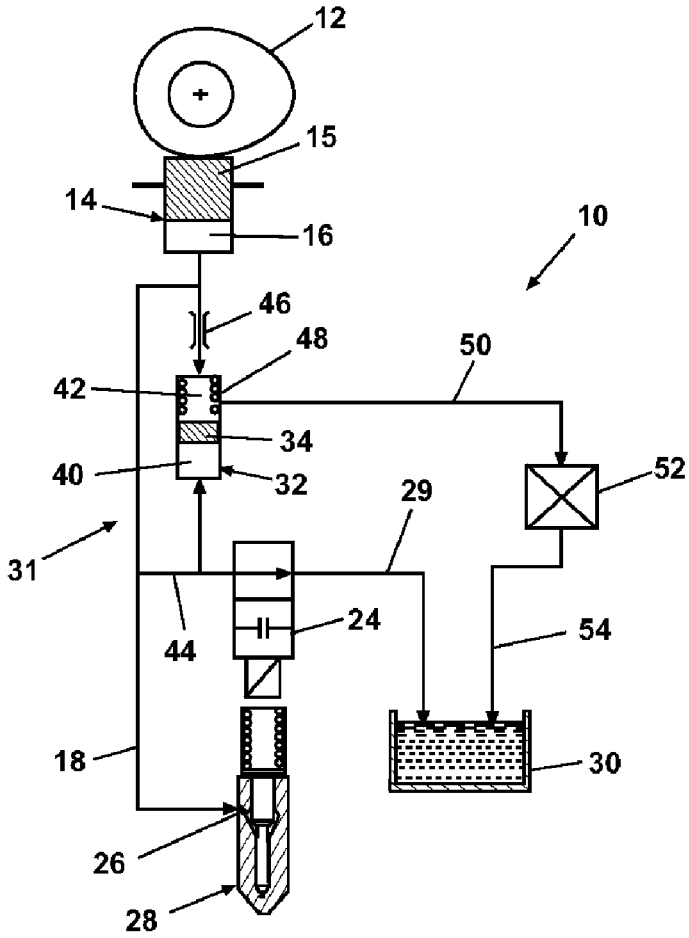
FIG. 1 is a schematic diagram of a fuel injection system with a spill chamber and piston according to the invention.
Figure 7:
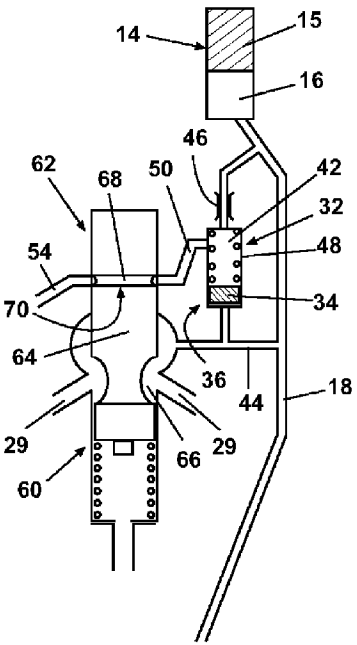
FIG. 7 is a schematic diagram of the fuel injection system of FIG. 6 in a position for filling fuel prior to pressurization.
Figure 6:
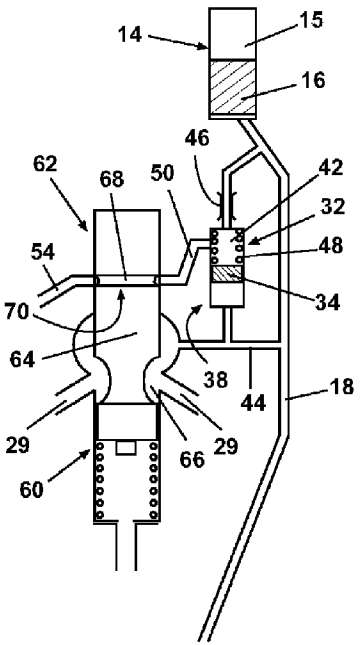
FIG. 6 is a schematic diagram of the fuel injection system of FIG. 5 in a position for spilling fuel to terminate the injection event.
Figure 5:
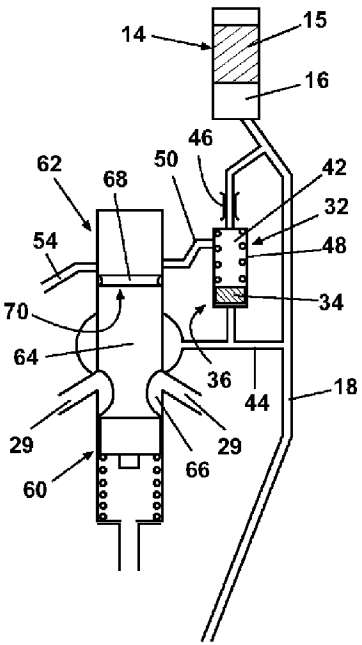
FIG. 5 is a schematic diagram of several components of a fuel injection system, with one embodiment of a spill chamber and piston according to the invention, in a position for fuel injection.

A fuel injection system 10 incorporating the invention is generally indicated schematically in FIG. 1. An engine driven cam 12 drives a pump 14 that typically comprises a plunger 15 disposed for reciprocating movement in a pumping chamber 16. The pump 14 is connected to an injector 28 via a high-pressure fuel line 18. The pump 14 may be a separate unit pump connected via the high-pressure fuel line 18 to the injector 28, or alternatively, it may be an integral part of a unit injector. Further, it is appreciated that although an embodiment of the present invention is broadly illustrated in FIG. 1, the exemplary implementation in FIGS. 5–7 is included for illustration purposes. There are many different ways to implement the present invention in accordance with the schematic illustration in FIG. 1.

With continuing reference to FIG. 1, a control valve 24 is disposed to route pressurized fuel from the pumping chamber 16 to an outlet 26, which in turn, connects to the injector 28 when the control valve 24 is closed. When the control valve 24 is open, fuel spills from the high-pressure fuel line 18, the pumping chamber 16, and the injector 28 to a low-pressure reservoir 30 by way of a low-pressure fuel line 29. The control valve 24 is conventional, typically operated electronically where it closes when activated and opens when deactivated.

Figure 2:
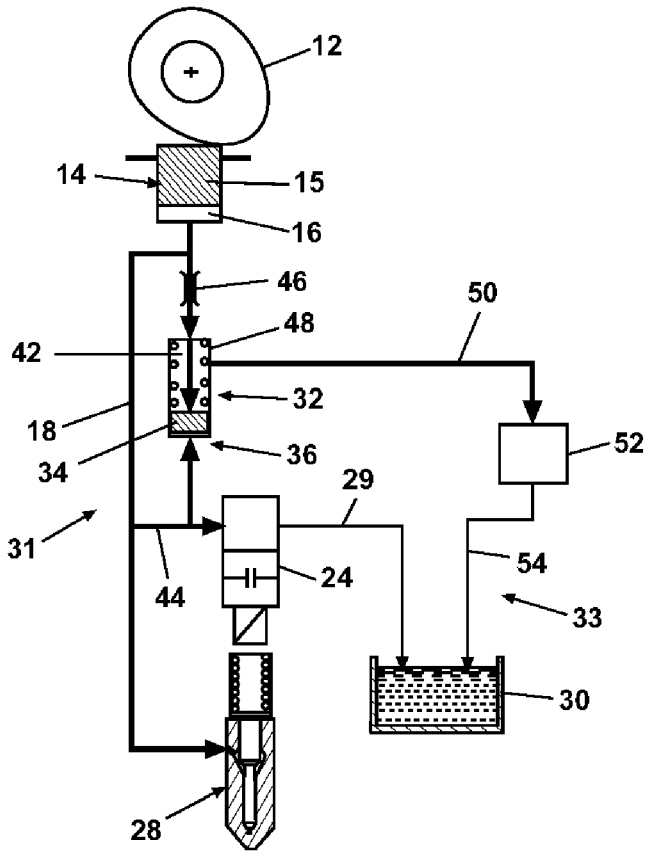
FIG. 2 is a schematic diagram of the fuel injection system of FIG. 1 during an injection event.
Figure 3:
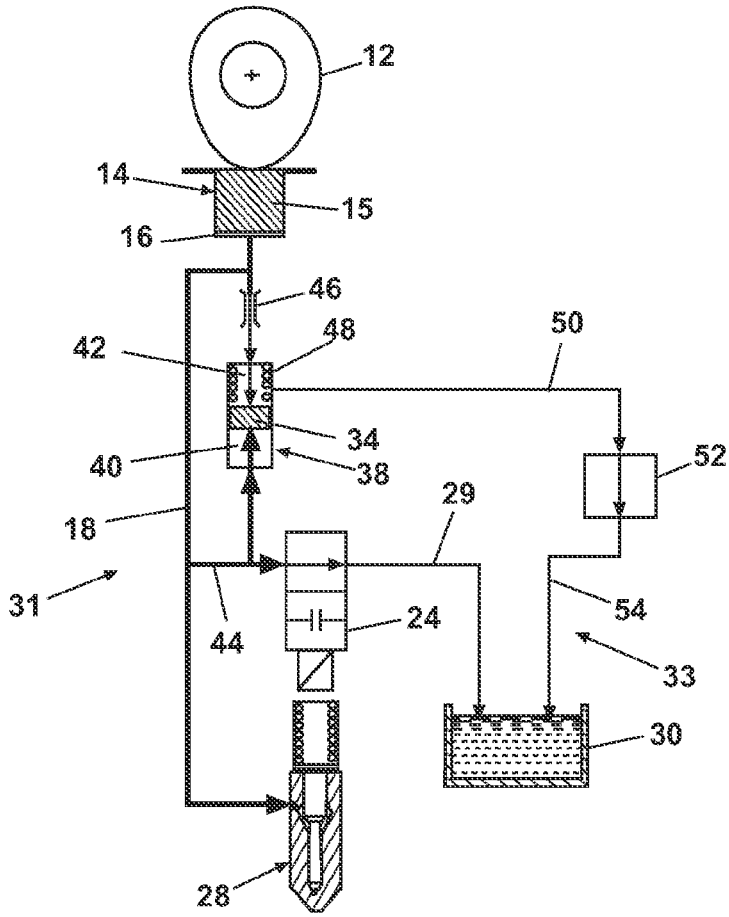
FIG. 3 is a schematic diagram of the fuel injection system of FIG. 1 during a spill event.
Figure 4:
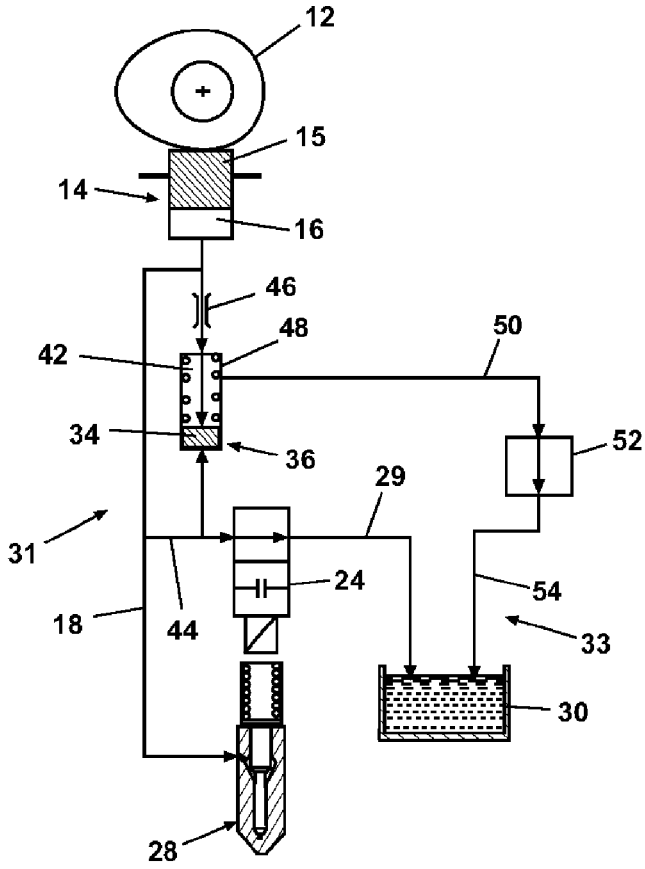
FIG. 4 is a schematic diagram of the fuel injection system of FIG. 1 during a fill event.

In accord with the invention, and looking now also at FIGS. 2–4, a spill chamber 32 has a piston 34 disposed for reciprocal movement therein between a first position 36 (shown in FIGS. 2 and 4) and a second position 38 (shown in FIG. 3). The piston 34 divides the spill chamber 32 into a pressure side 40 and a spring side 42. The pressure side 40 fluidly connects to the high pressure fuel line 18 or, as shown, to a high pressure conduit 44 leading from the high pressure fuel line 18 to the control valve 24. The spring side 42 fluidly connects to the high-pressure fuel line 18 or to the pump chamber 16 by way of a restriction 46. A spring 48 in the spring side 42 biases the piston 34 toward the first position 36. A spill conduit 50 fluidly connects the spring side 42 to a spill valve 52. And a low-pressure spill line 54 connects the spill valve 52 to the low-pressure reservoir 30. The spill valve 52 and the control valve 24 are synchronized to open and close together.

The high-pressure fuel line 18, pumping chamber 16, injector 28, conduits leading therefrom to the control valve 24 and to the restriction 46, and the pressure side 40 of the spill chamber 32 can all be considered a high pressure circuit 31. The reservoir 30, the low-pressure fuel line 29, and the low-pressure spill line 54 can all be considered a low-pressure circuit 33. The spring side 42 of the spill chamber 32 and the spill conduit 50 can be considered transitional.

In the events illustrated in FIGS. 2–4 explained below, a bold line indicates high pressure and a thin line indicates low pressure. A fuel injection event is triggered when fuel has been drawn into the high pressure circuit 31 and the control valve 24 is activated, closing the valve, while the plunger 15 advances in the plunger chamber 16 to pressurize the fuel in the high-pressure line 18 and in the injector 28. Meanwhile, the spill valve 52 synchronously closes with the control valve 24. Pressure increases on both sides of the piston 34 and in the spill conduit 50 so that the piston is pressure balanced. But the bias of the spring 48 tends to urge the piston 34 toward the first position 36 or maintain the piston 34 at the first position 36 if it is there already. In the first position 36, high pressure is equalized on both sides of the piston 34. In conventional manner, when the pressure exceeds a set point in the injector 28, a nozzle in the injector is opened and fuel is expelled and atomized into the cylinder. This condition is called an injection event and is shown in FIG. 2.

Pressure continues to build as the plunger 15 continues its advance until injection is to terminate, at which time the control valve 24 is activated to open. Opening the control valve 24 starts a spill event where fuel is vented from the high-pressure circuit 31 toward the reservoir 30. Simultaneously with opening of the control valve 24, the spill valve 52 is urged open, causing pressure in the spring side 42 of the spill chamber 32 to drop as fuel spills from the spring side to the reservoir 30 through the spill conduit 50, the spill valve 52 and the low-pressure spill line 54. Meanwhile, the restriction 46 obstructs fuel flow into the spring side 42. The result is eventually a pressure imbalance across the piston 34 because the pressure side 40 remains at a higher pressure. As the combined force of the pressure in the spring side 42 and the spring bias drops below the higher pressure remaining in the pressure side 40, the pressure imbalance urges the piston 34 toward the second position 38, thereby increasing the available volume of fuel in the high pressure circuit 31. This spill event condition is shown in FIG. 3. Preferably the dimensions are sized to permit no more than about 5% increase in the volume of the high pressure circuit 31.

The increased volume in the high pressure circuit 31 accelerates the already dropping pressure, slowing the flow of fuel through the control valve 24. As the pressure in the high pressure circuit 31 drops below the bias of the spring 48, the spring urges the piston 34 again toward the first position 36. The action of the spill chamber 32 and the piston 34 is enough to reduce the possibility of vapor formation when the pressure in the high pressure circuit 31 drops rapidly to zero. At this point, the plunger 15 begins to retreat in the plunger chamber 16 with the low pressure circuit 33 and the high pressure circuit 31 equalized or nearly equalized at a low pressure. Fuel is drawn into the high pressure circuit 31 during the fill event. This condition is shown in FIG. 4. Eventually, action of the cam 12 causes the plunger 15 to reverse direction and proceed to advance, increasing pressure for the next injection event.

It will be appreciated that with no vapor formation in the high pressure circuit 31 during the spill event, there is less opportunity for cavitation between injection events, and a subsequent injection event can occur timely because the plunger 15 is pressurizing only fluid, not a gas. It has also been found that, whether or not vapor formation occurs, the invention results in quicker termination of an injection event. Consequently, the invention is suitable for applications where speeding the end of injection is desirable, such as in common rail injection systems and in applications where reduced emissions are preferred.

Another embodiment of the invention is illustrated in FIGS. 5–7 where like components in the drawings bear like numerals. All components of the high pressure circuit 31 and the low pressure circuit 33 remain the same. In this embodiment, however, the control valve 60 and the spill valve 62 are different. In fact, the spill valve 62 is incorporated into the control valve 60, to work synchronously. The control valve 60 comprises a barrel 64 having a first annular groove 66 and a second annular groove 68. The first annular groove 66 is disposed to move into registry with the high pressure side 31 and the low pressure side 32 when the control valve 60 is deactivated, and move out of registry with the high pressure side 31 when the control valve is activated. Here, the first annular groove 66 is disposed relative to the high pressure conduit 44 and low-pressure fuel line 29 so that, when the control valve 60 is opened it is fluidly connected to both the high pressure conduit 44 and low-pressure fuel line 29. When the control valve 60 is closed, the first annular groove 66 is not fluidly connected to the high pressure conduit 44.

The spill valve 62 comprises the second annular groove 68 that, in conjunction with the barrel 64 of the control valve 60, functions as a spool valve 70. The spill conduit 50 runs from the spring side 42 of the spill chamber 32 to the control valve 60. Similarly, the low-pressure spill line 54 runs from the control valve 60 to the reservoir 30. Both are positioned so that when the control valve 60 is open, the spool valve 70 is also open and when the control valve 60 is closed, the spool valve 70 is also closed. Here, the second annular groove 68 is disposed relative to the spill conduit 50 and the low-pressure spill line 54 so that, when the control valve 60 is opened, it is fluidly connected to both the spill conduit 50 and the low-pressure spill line 54. During an injection event as shown in FIG. 5, the control valve 60 is closed when it is actuated. Consequently, the spool valve 70 is also closed. High pressure is equalized on both sides of the spill chamber piston 34 so the spring 48 urges the piston to the first position 36. In conventional manner, when the pressure exceeds a set point in the injector 28, a nozzle in the injector is opened and fuel is expelled and atomized into the cylinder. This injection event is shown in FIG. 5.

Pressure continues to build as the plunger 15 continues its advance until injection is to terminate, at which time the control valve 60 is actuated to open. Consequently, the spool valve 70 simultaneously opens. Opening the control valve 60 and the spool valve 70 starts a spill event where fuel is vented from the high pressure circuit 31 toward the low pressure circuit 33. With the spool valve 70 open and the restriction 46 in place between the spring side 42 and the high pressure conduit 18, pressure in the spring side 42 drops faster than pressure in the pressure side 40 as fuel spills from the spring side through the spill conduit 50. The result is a pressure imbalance across the piston 34 because the pressure side 40 remains at a higher pressure. The pressure imbalance urges the piston 34 toward the second position 38 against the spring bias, thereby increasing the available volume of fuel in the high pressure circuit 31. This condition is shown in FIG. 6. Preferably the dimensions are sized to permit no more than about 5% increase in volume.

The increased volume in the high pressure circuit 31 accelerates the already dropping pressure, slowing the flow of fuel through the control valve 60. As the pressure in the high pressure circuit 31 drops below the bias of the spring 48, the spring urges the piston 34 again toward the first position 36. At this point, the plunger 15 retreats in the plunger chamber 16 with the low pressure circuit 33 and high pressure circuit 31 equalized or nearly equalized at a low pressure. Fuel is drawn into the high pressure circuit 31 during the fill event. This condition is shown in FIG. 7. Eventually, the plunger 15 reverses direction and proceeds to advance, increasing pressure for the next injection event.

While the invention has been specifically described in connection with certain specific embodiments thereof, it is to be understood that this is by way of illustration and not of limitation, and the scope of the appended claims should be construed as broadly as the prior art will permit.

What is claimed is:

1. In a fuel injection system comprising a pump fluidly connected to an injector nozzle by way of a high pressure conduit in a high pressure side for pressurizing fuel in the high pressure side prior to an injection event, and a control valve fluidly connected between the high pressure side and a low pressure side wherein the injection event occurs by opening the injector nozzle when the control valve is activated and the injection event is terminated by a spill event when the control valve is deactivated, the improvement comprising:

a spill chamber with a movable piston, fluidly connected between the high pressure side and the low pressure side, wherein the piston is movable between a first position that provides no change in the volume of the high pressure side and a second position that increases the volume of the high pressure side, and means to hold the piston in the first position until the termination of an injection event, whereby to absorb stored energy in the pressurized fuel during a spill event.

2. A fuel injection system according to claim 1 wherein the volume increase is about 5%.

3. A fuel injection system according to claim 1 wherein the holding means comprises a spring in a spring side of the spill chamber that biases the piston toward the first position.

4. A fuel injection system according to claim 3 further comprising a spill valve on the low pressure side of the spill chamber.

5. A fuel injection system according to claim 4 wherein holding means comprises the spring side being fluidly connected to the high pressure conduit.

6. A fuel injection system according to claim 5 wherein a pressure side of the spill chamber opposite the piston from the spring side is fluidly connected to the high pressure conduit.

7. A fuel injection system according to claim 5 wherein the spring side is fluidly connected to the high pressure conduit by way of a restriction.

8. A fuel injection system according to claim 1 further comprising a spill valve on the low pressure side of the spill chamber.

9. A fuel injection system according to claim 8 wherein the spill valve is a spool valve integral with the control valve.

10. A fuel injection system according to claim 9 wherein the control valve comprises a barrel with an annular groove disposed to move into registry with the high pressure side and the low pressure side when the control valve is deactivated, and move out of registry with the high pressure side when the control valve is activated.

11. A fuel injection system according to claim 10 wherein the spool valve comprises an annular groove on the barrel disposed to move into fluid communication with the spill chamber and the low pressure side when the control valve is deactivated, and move out of fluid communication with the spill chamber when the control valve is activated.

12. In a fuel injection system comprising a pump fluidly connected to an injector nozzle by way of a high pressure conduit in a high pressure side for pressurizing fuel in the high pressure side prior to an injection event, and a control valve fluidly connected between the high pressure side and a low pressure side wherein the injection event occurs by opening the injector nozzle when the control valve is activated and the injection event is terminated by a spill event when the control valve is deactivated, the improvement comprising: a spill chamber fluidly connected to the high pressure side, with a movable piston dividing the spill chamber into a first side and a second side, the spill chamber being configured to bias the piston toward the second side only until termination of an injection event, whereby to accelerate pressure drop in the high pressure side and overcome the effects of inertia in the control valve during a spill event.

13. A fuel injection system according to claim 12 wherein the second side is fluidly connected to the high pressure side whereby to increase the volume of the high pressure side at the beginning of the spill event.

14. A fuel injection system according to claim 13 wherein the volume increase is about 5%.

15. A fuel injection system according to claim 12 wherein both sides are fluidly connected to the high pressure side.

16. A fuel injection system according to claim 15 further comprising a restriction in the fluid connection between the first side and the high pressure side.

17. A fuel injection system according to claim 15 wherein the first side is fluidly connected to the low pressure side.

18. A fuel injection system according to claim 1 wherein the piston divides the spill chamber into a first side and a second side, both sides being fluidly connected to the high pressure side.

19. A fuel injection system according to claim 18 wherein a spring in the first side biases the piston toward the second side.

20. A fuel injection system according to claim 1 wherein the piston divides the spill chamber into a first side and a second side, and the holding means comprises the second side being fluidly connected to the high pressure side.

21. A fuel injection system according to claim 5 wherein the spring side is fluidly connected to the spill valve.

22. A fuel injection system according to claim 4 wherein the spill valve is synchronized with the control valve.

23. A fuel injection system according to claim 8 wherein the spill valve is synchronized with the control valve.

24. A fuel injection system according to claim 3 wherein the holding means further comprises the spring side being fluidly connected to the spill valve.

25. A fuel injection system according to claim 12 further comprising a spring on the first side of the piston.

26. A fuel injection system according to claim 12 wherein the first side is fluidly connected to the high pressure side.

* * * * *

UNITED STATES PATENT AND TRADEMARK OFFICE

CERTIFICATE OF CORRECTION

PATENT NO. : 7,066,151 B1
APPLICATION NO. : 10/907601
DATED : June 27, 2006
INVENTOR(S) : Mark Bos It is certified that error appears in the above-identified patent and that said Letters Patent is hereby corrected as shown below:

Column 2, line 44 reads: "...configured to bias the toward the second..."

It should read: "...configured to bias the piston toward the second..."

Column 2, line 45 reads: "...side only termination of an injection event."

It should read: ".....side only until termination of an injection event."

Claim 12, Column 7, line 7, reads: "...only until termination of an injection event,"

It should read: "...only until the termination of an injection event,"

Signed and Sealed this

Twenty-second Day of August, 2006

JON W. DUDAS
*Director of the United States Patent and Trademark Office*